US008459891B2

(12) United States Patent
Lhoyer

(10) Patent No.: US 8,459,891 B2
(45) Date of Patent: Jun. 11, 2013

(54) DUAL WIPER COSMETIC APPLICATOR

(75) Inventor: Patrick Lhoyer, Mouy (FR)

(73) Assignee: Albea Services, Gennevilliers (FR)

( * ) Notice: Subject to any disclaimer, the term of this patent is extended or adjusted under 35 U.S.C. 154(b) by 229 days.

(21) Appl. No.: 13/120,465

(22) PCT Filed: Aug. 5, 2009

(86) PCT No.: PCT/EP2009/005680

§ 371 (c)(1),
(2), (4) Date: Mar. 23, 2011

(87) PCT Pub. No.: WO2010/034376

PCT Pub. Date: Apr. 1, 2010

(65) Prior Publication Data

US 2011/0255912 A1 Oct. 20, 2011

(30) Foreign Application Priority Data

Sep. 23, 2008 (EP) ..... 08356130

(51) Int. Cl.
*A46B 17/08* (2006.01)
*A46B 11/00* (2006.01)

(52) U.S. Cl.
USPC ..... 401/122; 401/126; 401/129; 132/218

(58) Field of Classification Search
USPC ..... 401/121–122, 126–130; 132/218
See application file for complete search history.

(56) References Cited

U.S. PATENT DOCUMENTS 4,407,311 A * 10/1983 Gueret ..... 401/122
4,671,689 A 6/1987 Gueret
4,886,387 A * 12/1989 Goldberg et al. ..... 401/122
5,349,972 A * 9/1994 Dirksing et al. ..... 132/218
5,597,254 A * 1/1997 Vasas ..... 401/122
5,791,800 A * 8/1998 Katz ..... 401/122
6,283,659 B1 * 9/2001 Gueret ..... 401/122
6,371,129 B1 * 4/2002 Le Bras-Brown et al. .... 132/218
6,799,582 B2 * 10/2004 Kim ..... 132/317
7,229,228 B2 * 6/2007 Dieudonat et al. ..... 401/122
7,309,183 B2 * 12/2007 Dumler ..... 401/155
7,360,319 B1 * 4/2008 Goldstein et al. ..... 33/725
7,467,905 B2 * 12/2008 Habatjou ..... 401/127
7,578,071 B2 * 8/2009 Goldstein et al. ..... 33/725
8,272,140 B2 * 9/2012 Goldstein et al. ..... 33/725

FOREIGN PATENT DOCUMENTS

EP 1797790 A 6/2007
GB 1215762 A 12/1970

OTHER PUBLICATIONS

International Search Report mailed Feb. 3, 2010 (PCT/EP2009/005680); ISA/EP.

* cited by examiner

*Primary Examiner* — Huyen Le
*Assistant Examiner* — Jennifer C Chiang
(74) *Attorney, Agent, or Firm* — Banner & Witcoff, Ltd.

(57) ABSTRACT

An applicator for a cosmetic product is provided, which includes a container having an opening, a first wiper element coupled to the container, proximate the opening, and an applicator arrangement removably coupled to the container. The applicator arrangement includes an elongate hollow tube that is slidable through the first wiper element and has an opening defined by a rim at a distal end and a second handle at a proximal end. The rim defines a second wiper element, and the first handle is releasably fitted to the second handle. When the applicator arrangement is removed from the container the first wiper element scrapes excess cosmetic product from the applicator element and when the first handle is separated from the second handle the second wiper element scrapes excess cosmetic product from the applicator element.

15 Claims, 3 Drawing Sheets

DUAL WIPER COSMETIC APPLICATOR

CROSS-REFERENCE TO RELATED APPLICATIONS

This application is a U.S. National Stage application under 35 U.S.C. §371 of International Application No. PCT/EP2009/005680 (published as WO 2010/034376 A1), filed Aug. 5, 2009, which claims priority to European Application No. 08356130.8, filed Sep. 23, 2008. Benefit of the filing date of each of these prior applications is hereby claimed. Each of these prior applications is hereby incorporated by reference in its entirety.

FIELD OF INVENTION

This invention relates to an applicator for a cosmetic product, such as mascara.

BACKGROUND TO THE INVENTION

There are a number of cosmetic product applicators having arrangements for wiping excess cosmetic product from the applicator. These typically include providing a wiper arrangement through which an applicator element can be drawn, the wiper arrangement accordingly wiping excess cosmetic product from the applicator element. However, such arrangements define a single wiping action that typically would always leave the same amount of product on the applicator element for use.

It would, however, be desirable to provide a dual wiping action in which a user may select whether a relatively smaller amount of product remains on the applicator element for use, or whether a relatively larger amount of product remains on the applicator element for use. A number of dual wiper cosmetic applicators have been proposed to date. In one version, a pair of applicator elements is provided, with each applicator element being exposed to different amounts of cosmetic product, with the user then selecting the applicator element with the required amount of cosmetic product. In another version, a pair of wiper arrangements is provided, with the distance between the wiper arrangements being adjustable by the user, thereby adjusting the amount of cosmetic product to be wiped off the applicator element. However, both of these dual wiper cosmetic applicators tend to be relatively complicated devices having numerous components that overall make them structurally inefficient.

OBJECT OF THE INVENTION

It is therefore an aim of the present invention to provide a dual wiping action cosmetic applicator that is structurally simple and easy to use.

SUMMARY OF THE INVENTION

According to a first aspect of the invention there is provided an applicator for a cosmetic product, the applicator comprising:

- a container for storing the cosmetic product, the container defining an opening;
- a first wiper element coupled to the container, proximate the opening of the container; and
- an applicator arrangement removably coupled to the container, the applicator arrangement including:

- a stem having an applicator element at a distal end and a first handle at a proximal end, the applicator element extending into the container for receiving cosmetic product; and
- an elongate hollow tube that is slidable through the first wiper element, the hollow tube having an opening defined by a rim at a distal end and a second handle at a proximal end, the rim defining a second wiper element, wherein the stem can be slidably accommodated within the hollow tube so that the applicator element of the stem can extend beyond the opening defined by the rim of the hollow tube, wherein the first handle is releasably fitted to the second handle so that when the applicator arrangement is removed from the container the first wiper element scrapes excess cosmetic product from the applicator element and when the first handle is separated from the second handle the second wiper element scrapes excess cosmetic product from the applicator element.

In an example embodiment, the second handle of the applicator arrangement is coupled to the container, so that the applicator arrangement is removed from the container using the second handle.

In an example embodiment, the second handle comprises internal threading on a portion thereof for attaching to a threaded neck of the container.

In an alternate example embodiment, the second handle is fitted to a neck of the container using a releasable snap fit arrangement.

In an example embodiment, the first wiper element comprises a sheath for slidably accommodating the hollow tube, the sheath being accommodated within a threaded neck of the container.

In an example embodiment, the sheath terminates in a tapered distal end.

In an example embodiment, the second handle comprises external threading on an upper portion thereof for receiving and engaging with internal threading on a portion of the first handle.

In an alternate example embodiment, the first and second handles are connected together using a releasable snap fit arrangement.

In an example embodiment, the second handle and the hollow tube define an integral unit.

In an example embodiment, the second handle and the hollow tube are separate components that can be fitted to each other.

In an example embodiment, the applicator element is a brush.

In an example embodiment, the applicator element is a mascara brush and the cosmetic product is mascara.

In an example embodiment, the applicator element is a flocked applicator.

According to a second aspect of the invention there is provided an applicator arrangement for dispensing a cosmetic product, the applicator arrangement comprising:

- a stem having an applicator element at a distal end and a first handle at a proximal end, the applicator element being arranged to receive the cosmetic product;
- an elongate hollow tube haying an opening defined by a rim at a distal end and a second handle at a proximal end, the rim defining a wiper element, wherein the stem can be slidably accommodated within the hollow tube so that the applicator element of the stem can extend beyond the opening defined by the rim of the hollow tube, wherein the first handle is releasably fitted to the second handle so that when the first handle is separated from the second handle the wiper element scrapes excess cosmetic product from the applicator element.

In an example embodiment, the second handle comprises external threading on an upper portion thereof for receiving and engaging with internal threading on a portion of the first handle.

In an alternate example embodiment, the first and second handles are connected together using a releasable snap fit arrangement.

In an example embodiment, the second handle and the hollow tube define an integral unit.

In an example embodiment, the second handle and the hollow tube are separate components that can be fitted to each other.

In an example embodiment, the applicator element is a brush.

In an example embodiment, the applicator element is a mascara brush and the cosmetic product is mascara.

In an example embodiment, the applicator element is a flocked applicator.

DESCRIPTION OF PREFERRED EMBODIMENTS

Figure 1:
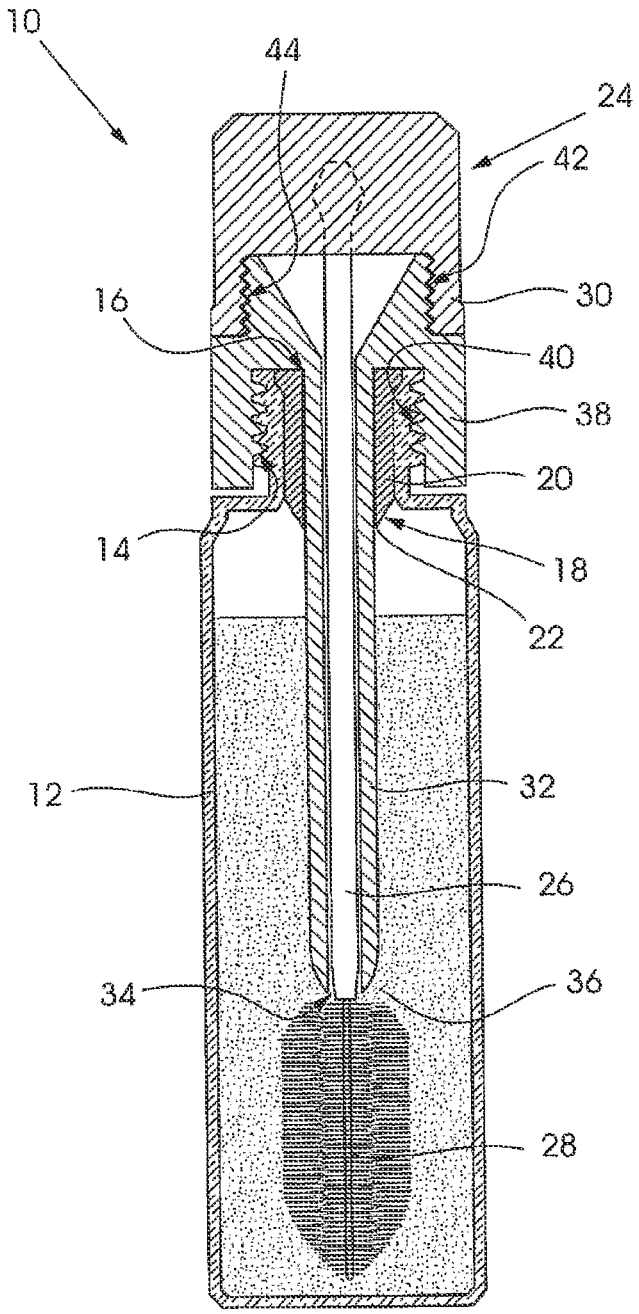
FIG. 1 shows a cross-sectional side view of an applicator for a cosmetic product in a fully closed configuration, according to an example embodiment.

Referring to the drawings, an applicator 10 for a cosmetic product is shown, the applicator 10 comprising a container 12 for storing the cosmetic product. The container comprises a threaded neck 14 that defines an opening 16. A first wiper element 18 is coupled to the container 12, proximate the opening 16 of the container 12. In an example embodiment, the first wiper element 18 comprises a flexible sheath 20 made of a resilient material, which is accommodated within the threaded neck 14 of the container 12. In an example embodiment, the sheath 20 terminates in a tapered distal end 22 that protrudes into the container 12.

The applicator 10 further comprises an applicator arrangement 24 that is removably coupled to the container 12. The applicator arrangement 24 includes an elongate stem 26 having an applicator element 28 at a distal end and a first handle 30 at a proximal end. The stem 26 has a first diameter. In the fully closed configuration shown in FIG. 1, the applicator element 28 extends into the container 12 for receiving cosmetic product.

In an example embodiment, the applicator element 28 is a brush, for example, a twisted wire brush. In particular, the applicator element 28 may comprise a mascara brush, with the cosmetic product within the container 12 comprising mascara. In further example embodiments, the applicator element 28 is a flocked applicator or a plastic molded applicator.

The applicator arrangement 24 further includes an elongate hollow tube 32 that is slidable through the first wiper element 18. The hollow tube 32 has an opening 34 defined by a rim 36 at a distal end and a second handle 38 at a proximal end. The rim 36 defines a second wiper element. The hollow tube 32 can be made from a material such as HDPE or an elastomeric material. The hollow tube 32 and the stem 26 each can be made from materials such as POM or PP.

The hollow tube 32 has a second diameter that is greater than the first diameter of the stem 26 so that the stem 26 can be slidably accommodated within the hollow tube 32. As best shown in FIG. 1, in the fully closed configuration, the applicator element 28 of the stem 26 extends beyond the opening 36 defined by the rim 36 of the hollow tube 32.

Figure 2:
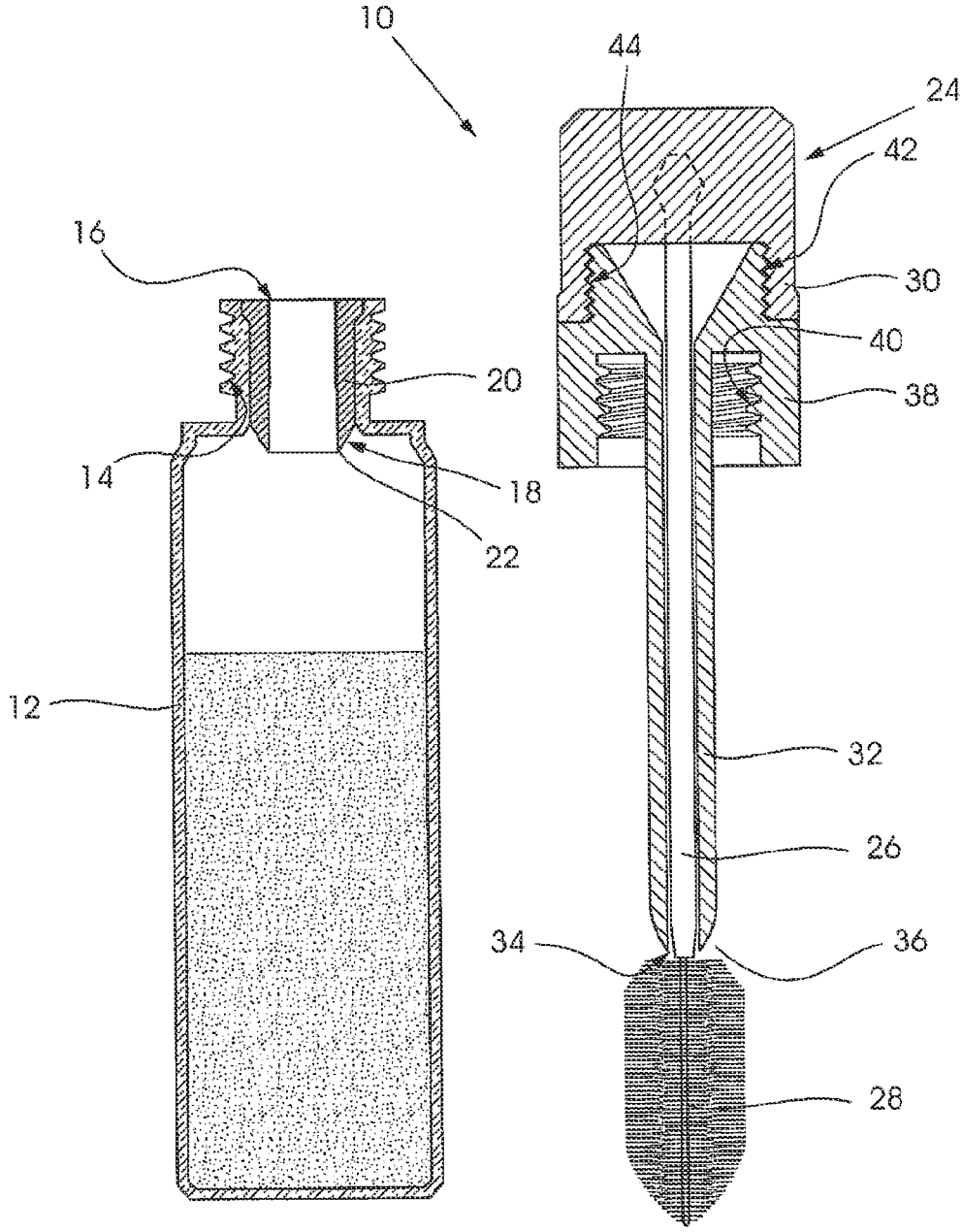
FIG. 2 shows a cross-sectional side view of the applicator shown in FIG. 1 in a first mode of use.
Figure 3:
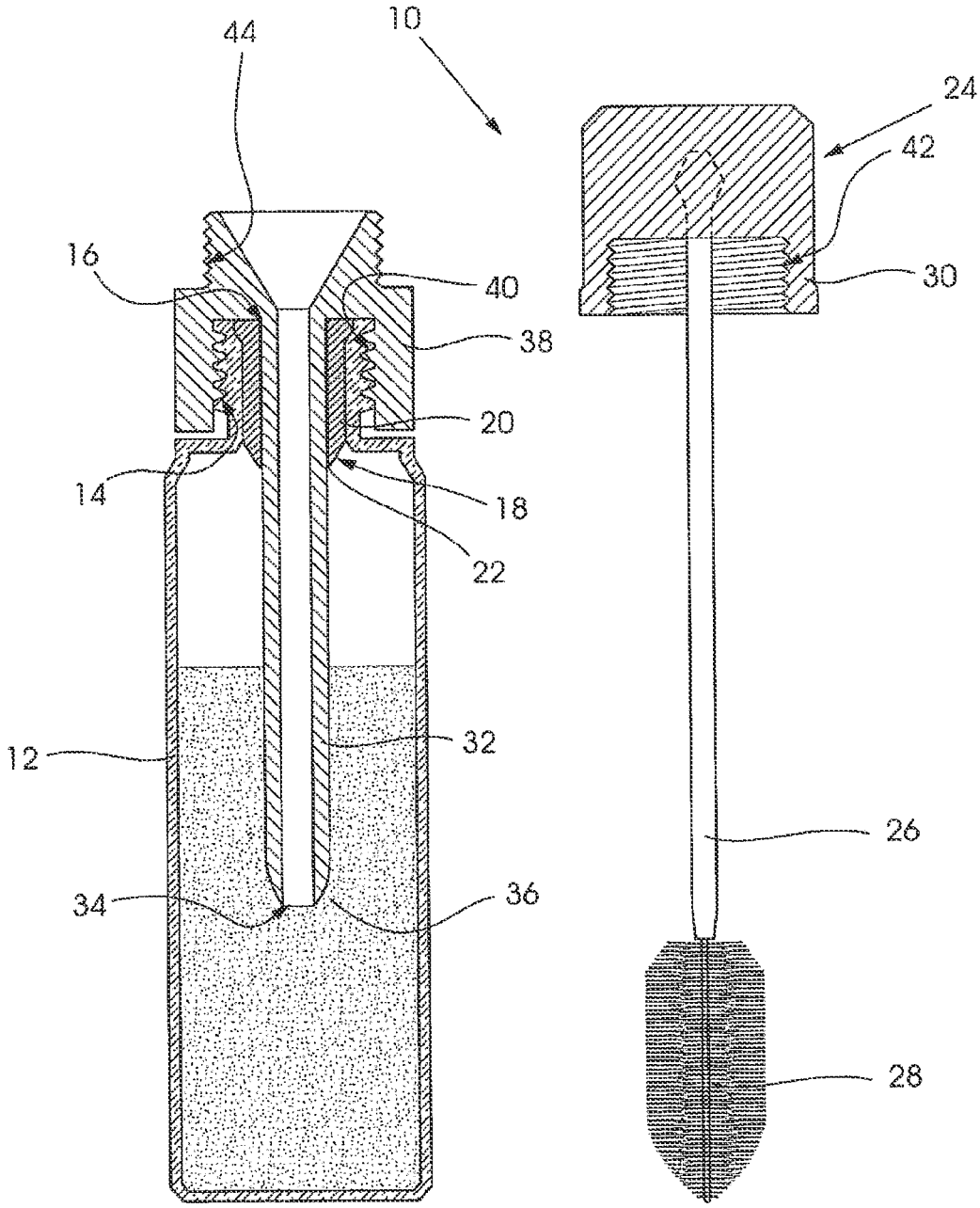
FIG. 3 shows a cross-sectional side view of the applicator shown in FIG. 1 in a second mode of use.

The hollow tube 32 is slidably accommodated within the first wiper element 18 and the first handle 30 is releasably fitted to the second handle 38 so that, in use and as best shown in FIG. 2, when the applicator arrangement 24 is removed from the container, the first wiper element 18 scrapes excess cosmetic product from the applicator element 28. Again, in use and as best shown in FIG. 3, when the first handle 30 is separated from the second handle 38 the second wiper element 36 scrapes excess cosmetic product from the applicator element 28. Typically, the first wiper element 18 is arranged to scrape less excess cosmetic product from the applicator element 28 than the second wiper element 36.

The present invention is thus directed to an improved cosmetic container 12 and applicator arrangement 24 having two wiper elements 18, 36 of different diameters to wipe more or less excess cosmetic product from the applicator element 28. Thus, should a user require a relatively light amount of the cosmetic product, so as to, in the case of mascara, provide a more subtle effect when the mascara is deposited on the lashes, then the first handle 30 will be removed from the second handle 38 and the container. Conversely, if the user requires a relatively heavy load of cosmetic product so as to provide a more intense makeup effect, then the entire applicator arrangement 24 will be removed from the container 12.

In an example embodiment, the second handle 38 of the applicator arrangement 24 is coupled to the container 12, so that the applicator arrangement 24 is removed from the container 24 by manipulating the second handle 38. In a particular example embodiment, the second handle 38 may comprise internal threading 40 on a portion thereof for attaching to the threaded neck 14 of the container 12. In an alternate example embodiment, the second handle 38 may be fitted to the neck of the container 12 using a releasable snap fit arrangement.

In an example embodiment, the second handle 38 comprises external threading 42 on an upper portion thereof for receiving and engaging with internal threading 44 on a portion of the first handle 30. In an alternate example embodiment, the first and second handles 30, 38 are connected together using a releasable snap fit arrangement.

In an example embodiment, the second handle 38 and the hollow tube 32 define an integral unit. In this case, the hollow tube 32 would be relatively rigid. Alternatively, the second handle 38 and the hollow tube 32 may be separate components that can be fitted to each other. In this latter case, the hollow tube 32 may be relatively more flexible.

The invention claimed is:

1. An applicator for a cosmetic product, the applicator comprising:

a container for storing the cosmetic product, the container defining an opening;

a first wiper element coupled to the container, proximate the opening of the container; and an applicator arrangement, for dispensing a cosmetic product and removably coupled to the container, the applicator arrangement comprising a stem having an applicator element at a distal end and a first handle at a proximal end, the applicator element extending into the container for receiving cosmetic product;

the applicator arrangement further comprises an elongate hollow tube having an opening defined by a rim at a distal end and a second handle at a proximal end, the rim defining a second wiper element, the stem being slidably accommodated within the hollow tube so that the applicator element of the stem extends beyond the opening defined by the rim of the hollow tube, the first handle being releasably fitted to the second handle so that when the applicator arrangement is removed from the container the first wiper element scrapes excess cosmetic product from the applicator element and when the first handle is separated from the second handle the second wiper element scrapes excess cosmetic product from the applicator element, wherein the elongate hollow tube is slidable through the first wiper element.

2. The applicator of claim 1, wherein the second handle comprises external threading on an upper portion thereof for receiving and engaging with internal threading on a portion of the first handle.

3. The applicator of claim 1, wherein the first and second handles are connected together using a releasable snap fit arrangement.

4. The applicator of claim 1, wherein the second handle and the hollow tube define an integral unit.

5. The applicator of claim 1, wherein the second handle and the hollow tube are separate components that can be fitted to each other.

6. The applicator of claim 1, wherein the applicator element is a brush.

7. The applicator of claim 1, wherein the applicator element is a mascara brush and the cosmetic product is mascara.

8. The applicator of claim 1, wherein the applicator element is a flocked applicator.

9. The applicator of claim 1, wherein the second handle of the applicator arrangement is coupled to the container, so that the applicator arrangement is removed from the container using the second handle.

10. The applicator of claim 1, wherein the second handle comprises internal threading on a portion thereof for attaching to a threaded neck of the container.

11. The applicator of claim 1, wherein the second handle is fitted to a neck of the container using a releasable snap fit arrangement.

12. The applicator of claim 1, wherein the first wiper element comprises a sheath for slidably accommodating the hollow tube, the sheath being accommodated within a threaded neck of the container.

13. The applicator of claim 1, wherein the sheath terminates in a tapered distal end.

14. The applicator according to claim 1, wherein the first wiper element has a different diameter compared to the diameter of the second wiper element.

15. Applicator according to claim 1, wherein the first wiper element is arranged to scrape less excess cosmetic product from the applicator element than the second wiper element.

* * * * *